US006088670A

United States Patent [19]

Takada

[11] Patent Number: 6,088,670

[45] Date of Patent: Jul. 11, 2000

[54] VOICE DETECTOR

[75] Inventor: Masashi Takada, Tokyo, Japan

[73] Assignee: Oki Electric Industry Co., Ltd., Tokyo, Japan

[21] Appl. No.: 09/069,858

[22] Filed: Apr. 30, 1998

[30] Foreign Application Priority Data

Apr. 30, 1997 [JP] Japan ..... 9-112250

[51] Int. Cl.[7] ..... G10L 5/06; G10L 9/00

[52] U.S. Cl. ..... 704/233; 704/211; 704/212

[58] Field of Search ..... 704/233, 211, 704/212

[56] References Cited

FOREIGN PATENT DOCUMENTS 8-202394 8/1996 Japan .

*Primary Examiner*—David R. Hudspeth
*Assistant Examiner*—Robin Sax
*Attorney, Agent, or Firm*—Rabin & Champagne, P.C.

[57] ABSTRACT

A voice detector that detects whether an input voice signal is voiced or unvoiced, the detector has a long-term averaging circuit calculating a long-term weighted average value, a short-term averaging circuit calculating a short-term weighted average value, a noise level discriminator discriminating based on the long-term weighted average value and the short-term weighted average value and a voice discriminator determining voiced/unvoiced terms based on comparison of the long-term weighted average value and the discriminated noise level.

10 Claims, 5 Drawing Sheets

VOICE DETECTOR

BACKGROUND OF THE INVENTION

1. Field of the Invention

The invention relates to a voice detector for detecting the presence/absence of a speech element in a voice signal, and more specifically to a detector adapted to use with a telephone, a navigation system, voice recognition equipment, a radio device or recording equipment, and which has a function to change a procedure according to the presence/absence of the speech element.

2. Description of the Background Art

A first conventional voice detector calculates a long-term weighted average value and a short-term weighted average value, of a voice signal level, and holds a fixed off-set, e.g., 6 dB with the calculated long-term weighted average value showing a smooth changing characteristic. If the short-term weighted average value exceeds a threshold value which is a value equal to the long-term weighted average value and the off-set, the detector identifies the voice signal as the voiced element.

A second conventional voice detector is disclosed in Japanese laid-open patent application 8-202,394. The voice detector detects a power of a voice signal in a predetermined fixed frame, then determines the presence/absence of the speech element. The following is an explanation of the second conventional voice detector described in the Japanese application.

First, a voice power calculator calculates a voice power of a fixed frame in a sample. A maximum value detector inputs a voice power signal based on the calculation of voice power by the power calculator, and detects the maximum value of the voice power within the fixed frame and respective front and the rear frames just before one of the fixed frames then outputs a maximum value signal based on the detected maximum voice to a discriminator. A zero-crossing rate calculator calculates the zero-crossing rate from the voice signal and outputs a resulting signal to the discriminator. Based on the maximum value signal received from the maximum value detector and the resulting signal from zero-crossing rate calculator on a frame, the discriminator determines whether the frame is a voiced frame or an unvoiced frame by using a threshold value set by a threshold value calculator. The discriminator outputs a frame type signal, e.g., 1 in case of a voiced frame, 0 in case of an unvoiced frame, to a hangover generator. When the frame type changes from voiced frame to unvoiced, the changeover generator output changes from the resulting frame type signal shown the unvoiced to the signal shown the voiced and outputs the resulting signal during a predetermined frames from the changed frame. The threshold value calculator watches the change of the voice power within a period defined by the discrimination result output by the discriminator, and renews the threshold value. In the second conventional detector, the reason why the maximum value detector detects the maximum value of the voice power within the frames, including the front and the rear frames, is as follows. The voice power is usually small just after the start of an utterance (the start of the utterance) and just before the end of the utterance (the end of the utterance). When the start of the utterance exists at the end of a preceding frame (front) and the end of the utterance exists at the start of a succeeding frame (rear), it is likely that the detector would mistakenly discriminate the current frame (the frame between the preceding and succeeding frames)as an unvoiced frame if the detection considered the voice power within the current frame alone. However, since the detector detects the maximumvalue of the voice power within the frames by including the front and rear frames as well, it can discriminate the value correctly.

However, in the first conventional voice detector, the threshold value is set based only on the long-term weighted average value, and the short-termweighted average value rapidly changes. Therefore, the short-term weighted average value repeatedly exceeds and does not exceed the threshold value, and alternately as a result the detector often discriminates voiced/unvoiced frames incorrectly. Also since the short-term weighted average value rapidly changes as a result of the rapid change of the noise, the short-term weighted average value repeatedly exceeds and does not exceed the threshold value, and again the detector similarly discriminates the voiced/unvoiced frames incorrectly.

Also, the above-described conventional voice detector has various problem left unsolved. For example, since the maximum value detector detects the maximum power value in the preceded frame and the discriminator discriminates the voiced/unvoiced frames based on the power value, it misdiscriminates rapid changes of noise within a frame as a voice element.

In the second conventional voice detector, the detector names the voice power signal during a predetermined period in a frame and watches the change of the power in the frame. If the change of the power is smaller than the threshold value during the predetermined period, the detector discriminates the frame as background noise, estimates the power of the background noise inputted during the period and also determines the threshold value. Therefore, when the background noise rapidly become small, the detector mistakenly discriminates the change of the noise level as a change in voice, in other words, discriminates the frame as the voiced frame. The detector identifies an estimated level of a background noise to be greater than the actual level. And the detector identifies a signal which should be identified as voiced instead as a signal within the background noise level. Especially, an incorrect identification often occurs at the beginning of an utterance and at the end of an utterance. In other words, the beginnings and endings of utterances that occur during frames that follow rapid changes in background voice are often mistakenly identified as unvoiced.

SUMMARY OF THE INVENTION

Therefore, it is an object of the present invention to provide a voice detector which is capable of accurately discriminating voiced/unvoiced frames, even when there are rapid changes in the noise level. It is another object of the present invention to provide a voice detector which is capable of accurately discriminating voiced/unvoiced frames even at the beginning and ending of the utterances. To accomplish these objectives, a voice detector according to the present invention includes a long-term averaging circuit that calculates a long-term weighted average sound level value, a short-term averaging circuit that calculates a short-term weighted average sound level value, a noise level discriminator that discriminates based on the long-term weighted average value and the short-term weighted average value, and a voice discriminator determining voiced/unvoiced term based on a comparison of the long-term and short term weighted average values and the discriminated noise level.

BRIEF DESCRIPTION OF THE DRAWINGS

These and other objects and features of the present invention will become more apparent from consideration of the following detailed description taken in conjunction with the accompanying drawings in which.

DESCRIPTION OF THE PREFERRED EMBODIMENTS

Figure 1:
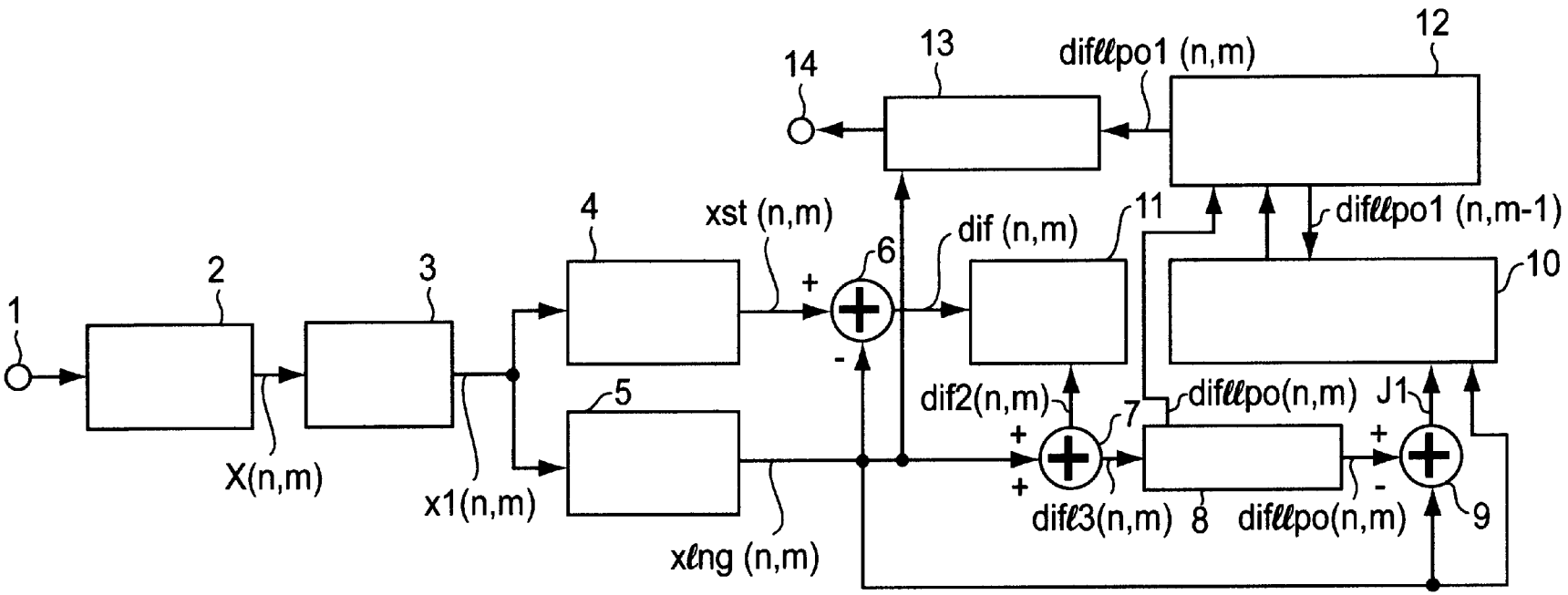
FIG. 1 is a schematic block diagram showing a voice detector of a first embodiment of the invention.

Referring to FIG. 1, the voice detector of the first embodiment includes a voice signal input terminal 1, a frame divider 2, two absolute value calculators 3 and 11, a short-term averaging circuit 4, a long-term averaging circuit 5, three adders 6, 7 and 9, a smoothing filter 8, a noise level discriminator 10, a noise level identifier 12, a voice discriminator 13, and an output terminal 14. A digital voice signal X(n) at a desired sampling frequency, e.g., 8 kHz, is inputted to the voice signal input terminal 1. The frame divider 2 divides the inputted voice signal X(n) in a specific unit length, e.g., 128 samples, to constitute one frame and outputs the divided signals to the absolute value calculator 3 in a frame.

In the first embodiment, since 128 samples are constituted as one frame, the inputted voice samples from the first sample to the 128th sample after initiating the action, are stored in the first frame. For example,the mth (m=1,2, . . . , 128) sample in the first frame is denoted as X(1,m). The 129th inputted voice sample, X(129) is the 1st sample in the second frame, and is denoted as X(2,1) after the procedure performed by the frame divider 2. In the same way, the overall kth inputted voice sample, X(k) is outputted from the frame divider 2 as the mth value in the nth frame (See equation (1)) below.

$$X(k)=X(n,m) \tag{1}$$

(k,n,m(m=1,2, . . . ,128) are an integral number and k=(128n)+m)

The absolute value calculator 3 calculates an absolute value x1(n,m) with regard to each sample X(n,m) of each frame from the frame divider 2 (See equation (2)below), and outputs the absolute value signal x1(n,m) to the short-term averaging circuit 4 and the long-term averaging circuit 5.

$$x1(n,m)=|X(n,m)| \tag{2}$$

The short-term average circuit 4 calculates a short-term weighted average value xst(n,m) and receives the absolute value x1(n,m) of the proceeded frame. On the other hand, the long-term averaging circuit 5 calculates a long-termweighted average value xlng(n,m) and receives the absolute value x1(n,m) of the preceding frame. The short-term averaging circuit 4 and the long term averaging circuit 5 can be adapted from a standard calculator in order to calculate a mathematical average. Also, these circuits can be provided by adapting a calculator or filter to calculate a "smoothing average" instead of a mathematical average, that is, a weighted average calculated after each sample input, which tends to provide a smoother output than would be provided if the current sample were weighted heavily in relation to the prior samples or previous calculated average, i.e. it tends to smooth out short term changes. In equations (3) and (4) below, the short-term weighted average value xst(n,m) and the long-term weighted average value xlng (n,m) are calculated by such a calculation of "smoothing average," (by what is hereinafter referred to as a "smoothing calculation."

$$xst(n,m)=a*xst(n,m-1)+(1-a)*x1(n,m) \tag{3}$$

$$xlng(n,m)=b*xlng(n,m-1)+(1-\beta)*x1(n,m) \tag{4}$$

In equations (3) and (4), the coefficients a and b (hereinafter "smoothing coefficients") are constants larger than 0 and smaller than 1. When the smoothing coefficient a (or β) is a small value, the detector follows rapid changes of the inputted absolute value x1(n,m) and the result of the calculation corresponding to a short-term weighted average value is provided. When the smoothing coefficient b (or a) is a large value, it does not follow rapid changes of the inputted absolute value x1(n,m), but does follow slow changes in the inputted absolute value x1(n,m), and also the result of the calculation corresponding to a long-term value is provided. The smoothing coefficients a and b can adopt any of several values, e.g., a=0.9, b=0.996 in the embodiment. In the above equations (3) and (4), when m is 1 (at the input of a sample at the beginning of a new frame), the short-term weighted average value xst(n−1,128) at the time of the final sample of the previous frame is adopted as the short-termweighted average value xst(n,m−1)=xst(n,0) just before the previous sample is input. In the same way, the long-term weighted average value xlng(n−1,128) at the time of inputting the final sample of the previous frame is adopted as the long-termweighted average value xlng(n,m−1)=xlng(n,0) just before the inputting of the previous sample. Also, xst(1,0) and xlng(1,0) are zero as an initial condition of the first frame. Other (nonzero) initial values also can be adopted, in other words, the initial value is not limited to be set to zero.

The short-term weighted average value xst (n,m) is outputted from the short-term averaging circuit 4 to the adder 6, and the long-term weighted average value xlng (n,m) is outputted from the long-term averaging circuit 5 to the adders 6,7 and 9, and the noise level discriminator 10 and the voice discriminator 13. The adder 6 calculates a difference dif(n,m) between the short-term weighted average value xst(n,m) and the long-term weighted average value xlng (n,m) according to the following equation, and outputs a different signal representative of the calculation to the absolute value calculator 11.

$$dif(n,m)=xst(n,m)-xlng(n,m) \tag{5}$$

As is apparent from equation (5), for initial values of zero for xst(1,0) and xling(1,0), the difference dif(1,0) is zero as an initial condition of the first frame. Of course for different initial values of xst(1,0) and xling(1,0), the initial value d(1,0) is not limited to zero.

The absolute value calculator 11 calculates an absolute value dif2(n,m) of output dif(n,m) of the adder 6 as represented in the following equation and outputs an absolute value signal to the adder 7.

$$dif2(n,m)=|dif(n,m)| \tag{6}$$

The adder 7 adds the output xlng (n,m) of the long-term averaging circuit 5 and the output dif2(n,m) of the absolute value calculator 11 to obtain an instant value difl3(n,m) of the threshold value for a voice detection as shown by equation (7) below, and which of course is always larger than the long-term weighted average value xlng(n,m).

$$\text{difl3}(n,m)=\text{xlng}(n,m)+\text{dif2}(n,m) \quad (7)$$

The smoothing filter 8 receives the output difl3(n,m) from the adder 7, and calculates a smoothing value difllpo(n,m) according to the following equation (8), and outputs this smoothing value to the adder 9 and the noise level identifier 12.

$$\text{difllpo}(n,m)=\gamma*\text{difllpo}(n,m-1)+(1-\gamma)*\text{difl3}(n,m) \quad (8)$$

The smoothing coefficient γis a coefficient for determining the following speed at which the output of the filter 8 follows changes of the output difl3(n,m) from the adder 7. If the coefficient γis small, then diflpo(n,m) follows a rapid change of the output difl3(n,m). And if this coefficient γis large, then difllpo(n,m) does not follow a rapid change of the output difl3(n,m), but rather reflects a slow change detection. It is enough that this coefficient γis larger than zero and smaller than one. In this embodiment, 0.9 is adopted. Also, when the sample number m of the frame is one, the previous frame data difllpo(n−1,128) is adopted as difllpo(n,m−1)=difllpo (n,0). And, zero is adopted as the initial value difllpo (1,0) of the first frame. Other initial values can be adopted.

The adders 6 and 7, the absolute value calculator 11 and the smoothing filter 8 serve to provide a changeable offset to the long-term weighted average value. The adder 9 subtracts the long-term weighted average value xlng(n,m) of the long-term averaging circuit 5 from the smoothing value difllpo(n,m) output by the smoothing filter 8 determines the first noise discriminate threshold value J1 as indicated by equation (9), and outputs a signal representing the values J1 to the noise level discriminator 10.

$$J1=\text{difllpo}(n,m)-\text{xlng}(n,m) \quad (9)$$

The identification value with the noise level offset difllpol (n,m−1) just before the noise level identifier 12 operates, is input to the noise level discriminator 10. The noise level discriminator 10 subtracts the long-term weighted average value xlng(n,m) provided by the long-term averaging circuit 5, from the noise level identification value difllpol(n,m−1), at the input of the previous sample.

To calculate the second noise discriminate value J2, according to the equation (10):

$$J2=\text{difllpol}(n,m-1)-\text{xlng}(n,m) \quad (10)$$

The discriminator 10 then discriminates which of the following conditions 1 or 2 is satisfied, based on the first and the second noise discrimination values J1 and J2, and outputs the resulting discrimination signal to the noise level identifier 12.

Condition 1: $J2*c1>J1$

Condition 2: $J2*c1\leqq J1$

As the coefficient c1, a value such as 2.5 may be adopted. However, other values of the coefficient c1 are also possible and is not limited to 2.5. Satisfaction of Condition 1 means that the noise level changes are great in comparison with the previous level during the sampling. On the other hand, satisfaction of Condition 2 means that the noise level is similar to the previous level during the sampling. Therefore, the noise level identifier 12 renews the noise level identification value difllpol(n,m) based on the output of the noise level discrimination 10 and outputs the renewed noise level identification value difllpol(n,m) to the voice discriminator 13 for a determination of the existence of voice in the frame as described below, and also feeds it back to the noise level discriminator 10 (to serve for the determination of the discrimination signal in the procession of the next sample), and the identifier 12 calculates the noise level identification value difllpol(n,m) according to the following equations (11) and (12):

<when the condition 1 is satisfied>

$$\text{difllpol}(n,m)=s*\text{difllpol}(n,m-1)+(1-s)*\text{difllpo}(n,m) \quad (11)$$

<when the condition 2 is satisfied>

$$\text{difllpol}(n,m)=\text{difllpol}(n,m-1) \quad (12)$$

The cofficient s is a smoothing coefficient having a range from zero to one. For example, 0.966 is adopted as the coefficient s in the present embodiment. A large value, near a maximum value of a voice amplitude, is adopted as the initial value of the noise level identification value difllpol (n,m). For example, the initial value of the noise level identification value difllpol(n,m) is set at 0.7 with the maximum value of the voice amplitude set at 1. A fixed value need not be adopted as the initial value. Also, during the period from the first sample to the fiftieth sample, equation difllpol(n,m) can be calculated according to (11) without consideration as to whether Conditions 1 and/or 2 are satisfied.

The voice discriminator 13 compares the noise level identification value difllpol(n,m) output by the noise level identifier 12, to the long-term weighted average value xlng (n,m) output by the long-term weighted average circuit 5. If there is at least one sample term satisfying the equation $\text{difllpol}(n,m)\leqq\text{xlng}(n,m)$, the voice discriminator 13 discriminates the existence of voice in the entire nth frame. In the other cases, the discriminator 13 discriminates the absence of voice in the whole of the nth frame. Then, it outputs a resulting signal indicative of voice or nonvoice to the next device through the output terminal 14.

<Operation of the First Embodiment>

The following is a description of the operation of the voice detector of the first embodiment.

Figures 2A, 2B, 2C, 2D, 2E:
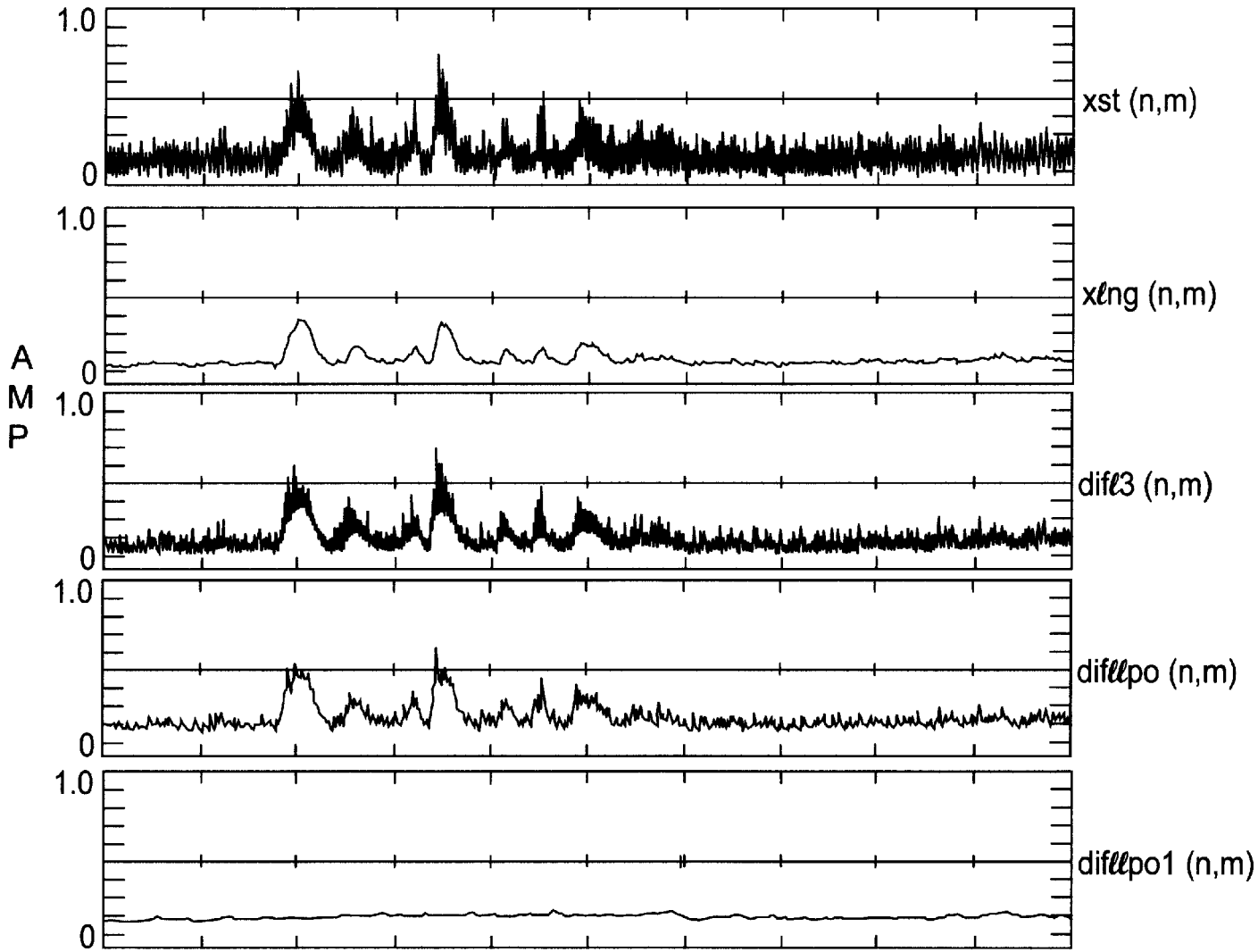
FIG. 2 is a waveform diagram of signals generating by the detector of the first embodiment.

When a digital voice signal X(n), with samples at 8 kHz, is received by the voice signal input terminal 1 and input to the frame divider 2, the divider 2 unit divides the samples into frames and outputs the divided signal in successive frame units to the absolute value calculator 3. The absolute value calculator 3 calculates the absolute value x1(n,m) of each sample X(n,m) of each frame received from the frame divider 2, and outputs the resulting absolute value signal to the short-term averaging circuit 4 and the long-term averaging circuit 5. The short-term averaging circuit 4 calculates the short-term weighted average value xst(n,m) of the absolute value x1(n,m) and the long-term averaging circuit 5 calculates the long-term weighted average value xlng(n,m) of the absolute value x1(n,m) as described above. FIG. 2(A) shows an example of the short-term weighted average value xst(n,m) and FIG. 2(B) shows an example of the long-term weighted average value xlng (n,m) [corresponding to the long-term weighted average value]. As shown at FIG. 2(A), noise elements in the short-term weighted average value xst(n,m) remain after the averaging. However, as shown at FIG. 2(B), noise elements in the long-term weighted average value xlng(n,m) are almost entirely removed after the averaging. After the adder 6 calculates the difference dif(n,m) between the short-term weighted average value xst(n,m) and the long-term weighted average value xlng(n,m), the absolute value calculator 11 calculates the absolute value dif2 (n,m), to which the adder 7 adds the long-term weighted average value xlng(n,m) to obtain an instant value difl3(n,m) of the threshold for voice detect ion. As shown at FIG. 2(C), the instant value difll3(n,m) of the threshold for the voice detection, is always larger than the long-term weighted average value xlng(n,m), and it reflects the short-term weighted average value xst(n,m).

The instant value difl3(n,m) is subjected to a smoothing procedure by the smoothing filter 8 to obtain the threshold value difllpo(n,m) for voice detection. FIG. 2(D) shows the output of the smoothing filter 8, when the instant value difl3(n,m) of the threshold value for voice detection is as shown in FIG. 2(C). As shown at FIG. 2(D), the changes in the smoothing value difllpo(n,m) are small in comparison to the instant value difl3 (n,m). The adder 9 subtracts the long-term weighted average value xlng(n,m) output by the long-term averaging circuit 5, from the instant value difllpo (n,m) and outputs a resulting difference signal, that is, the first noise discrimination value J1 described above to the noise level discriminator 10. The first noise discrimination value J1 is related to the change of the noise level and the changes of the short-term weighted average value xst(n,m) and the long-term weighted average value xlng(n,m), and is the smoothing value of the noise level.

The noise level discriminator 10 receives the identification value with the noise level offset difllpol (n,m−1) from the noise level identifier 12. It subtracts the long-term weighted average value xlng(n,m) output by the long-term averaging circuit 5, from the identification value difllpol (n,m−1) to obtain the second noise discrimination value J2, as described above. Then, the noise level discriminator 10 compares the first noise discrimination value J1 with c1 times the second noise discrimination value J2 (Conditions 1 and 2 described above). If the latter value is larger than the former value (when the above mentioned Condition 1 (J2*c1>J1) is satisfied), then based on this determination, the identification =value difllpol(n,m) is renewed by the identifier 12, according to equation (11) above. On the other hand, if the latter value is smaller than the former value (when the above mentioned Condition 2 (J2*c1≦J1) is satisfied), then based on this determination, the identification value is not renewed by the noise level identifier 12 (stays the same), according to equation (12). Thus, if the noise level identifier 12 receives from noise level discriminator 10 a discrimination result signal that Condition 1 is satisfied, it renews identification value difllpol(n,m) at the time of the current sampling by application of the smoothing procedure to the identification value difllpol (n,m−1) and the output difllpo(n,m) from the smoothing filter 8.

On the other hand, if the noise level identifier 12 receives from the noise level discriminator 10 a discrimination result signal that Condition 2 is satisfied, then it adopts for the current time as the discrimination value difllpol(n,m), the identification value difllpol(n,m−1) adopted following the immediately previous sampling. The renewed identification value with the noise level off-set difllpol(n,m) is outputted to the voice discriminator 13 and outputted to the noise level discriminator 10 as the identification value difllpol(n,m−1) for its next discrimination procedure.

FIG. 2(E) illustrates the identification value with noise level off-set difllpol(n,m). The identification value with the noise level off-set difllpol(n,m) changes based on the changes of the short-term weighted average value xst(n,m) and the long-term weighted average value xlng(n,m). The element of the change is smooth, except for a voiced element and reflects the noise background, as shown in FIG. 2(E).

The voice discriminator 13 compares the long-term weighted average value xlng(n,m) to the noise level off-set identification value difllpol(n,m). When at least one sample term in a frame shows the former value to be larger than the latter value, the voice discrimination 13 outputs to the output 14 a signal which denotes that the frame is a voice frame. In the other cases, the resulting signal output through the output 14 denotes that the frame is not voiced.

Figure 3:
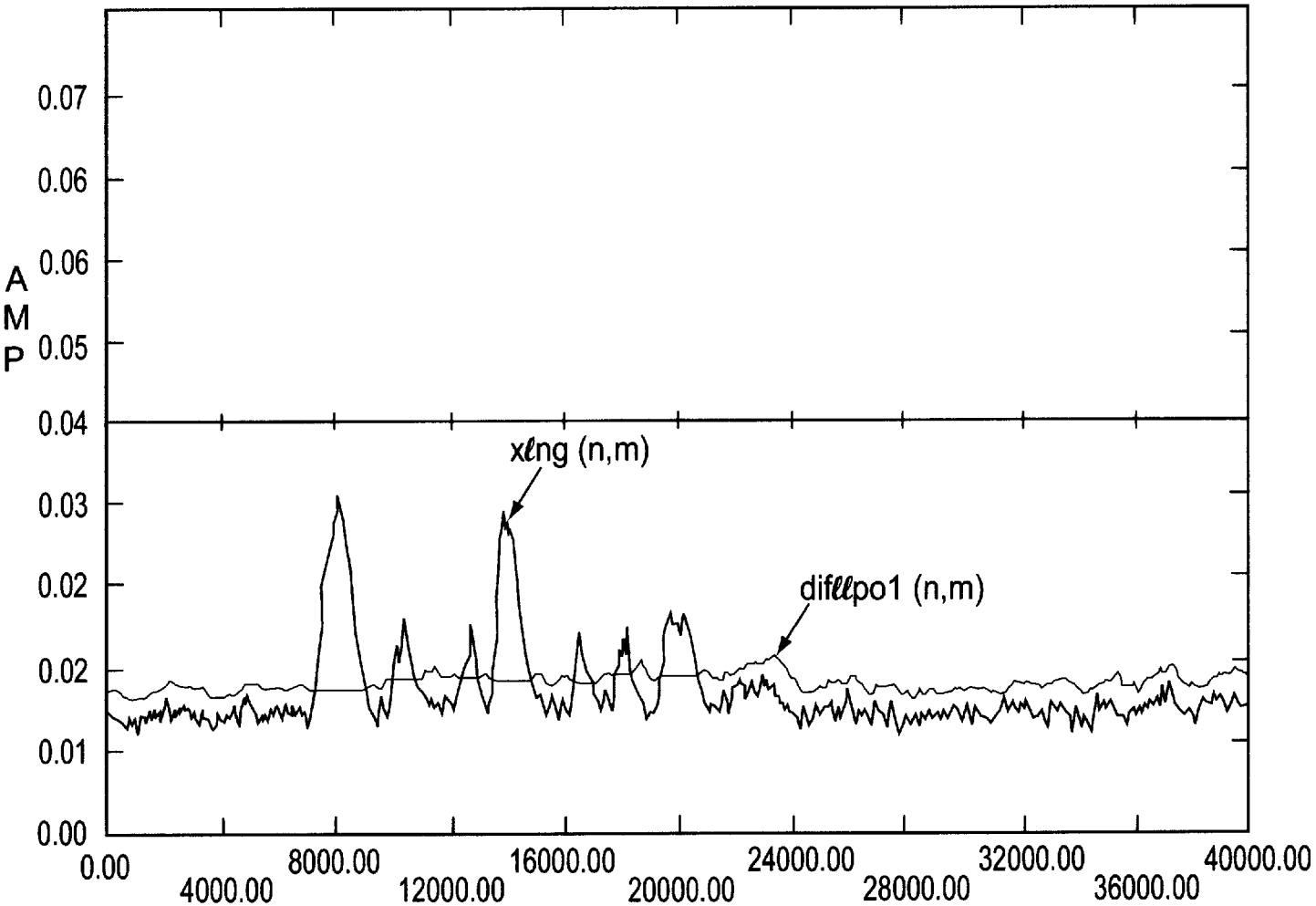
FIG. 3 is a diagram showing signals input to the voice discriminator.

FIG. 3 denotes a sample of a long-termweighted average value signal xlng(n,m), output by the long-term averaging circuit 5, together with a noise level off-set sample identification value difllpol(n,m). As shown in FIG. 3, the frame length is established as a long time. Since the noise level off-set identification value difllpol(n,m) reflects only the noise level (without any voice element), the portion of the long-term weighted average value xlng(n,m) that exceeds the identification value is discriminated as a voiced term.

The embodiment described above has various unprecedented advantages. For example, the voice detector compares the long-term weighted average value of the input voice signal level to the background noise level with the changeable off-set identified from the long-term weighted average value and the short-term weighted average value, and discriminates the voiced frames from unvoiced frames. Therefore, the detector of the present invention avoids rapid changes in the short termweighted average value when using the above-described first conventional voice detector.

The detector of the present invention also can discriminate more consistently than the second conventional detector which discriminates the voiced from the unvoiced by comparing a threshold level value from a noise level with the maximum value of the voice power.

The detector of the invention takes another look at the background noise level (threshold level) when processing each sample in a frame. If a rapid change of the background noise occurs in a frame, the detector renews the background noise level with the changeable off-set and follows the rapid change of the noise. Therefore, the detector avoids erroneous discrimination.

The voice detector takes another look at the background noise level (threshold level) with the changeable off-set. If a rapid change of the background noise occurs in a frame, the detector renews the background noise level with the changeable off-set, follows the rapid change of the noise, and discriminates between the voiced and the unvoiced in each frame. Therefore, it prevents discriminating the background noise level to be larger than its actual level during the plurality of the frames like the second conventional detector. In other words, the detector prevents continuous discrimination of the signal to be a noise level when in fact it is voiced. Therefore, if the sample is a frame being detected is judged to be voiced, so that the entire frame is judged to be a voiced frame, the detector prevents a breaking off of the beginning and the end of an utterance with a change in the noise level. If any samples in a frame are discriminated to be voiced, the detector discriminates the entire frame to be voiced, thereby preventing a breaking off of the beginning and the end of the utterance.

<Second Embodiment>

Figure 4:
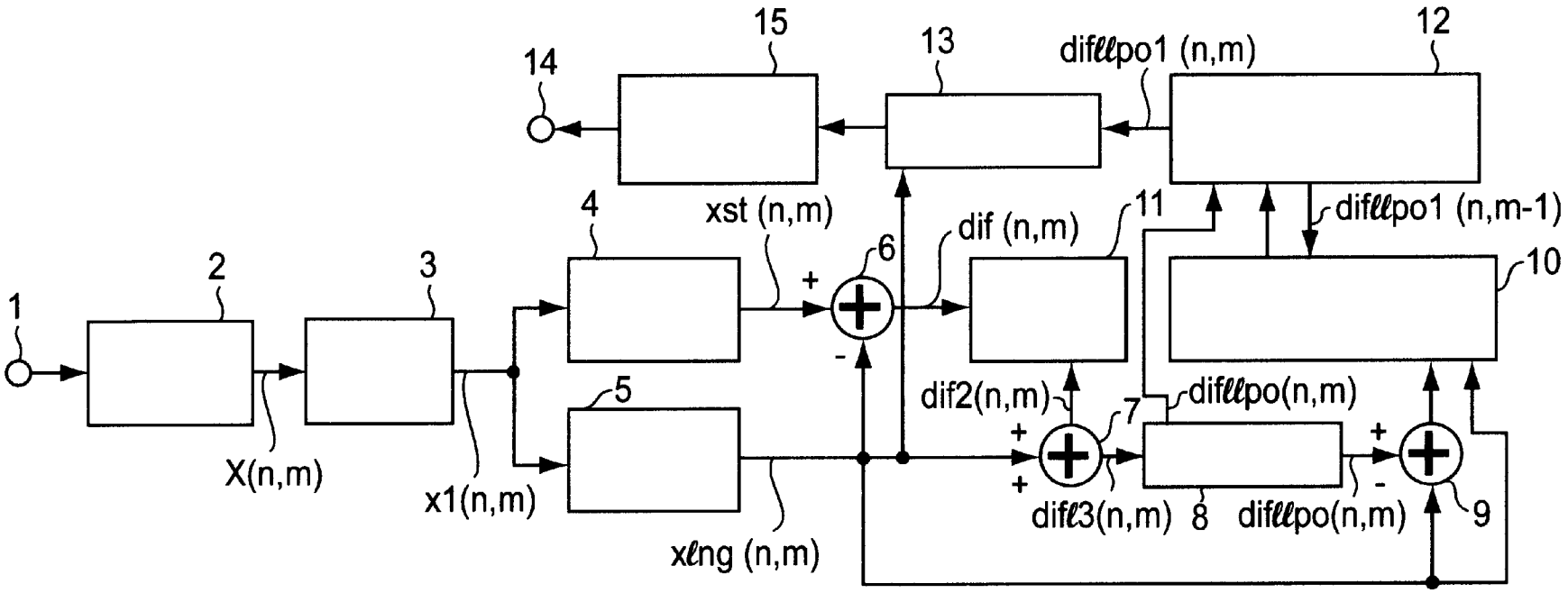
FIG. 4 is a schematic block diagram showing a voice detector of a second embodiment of the invention.
Figure 5:
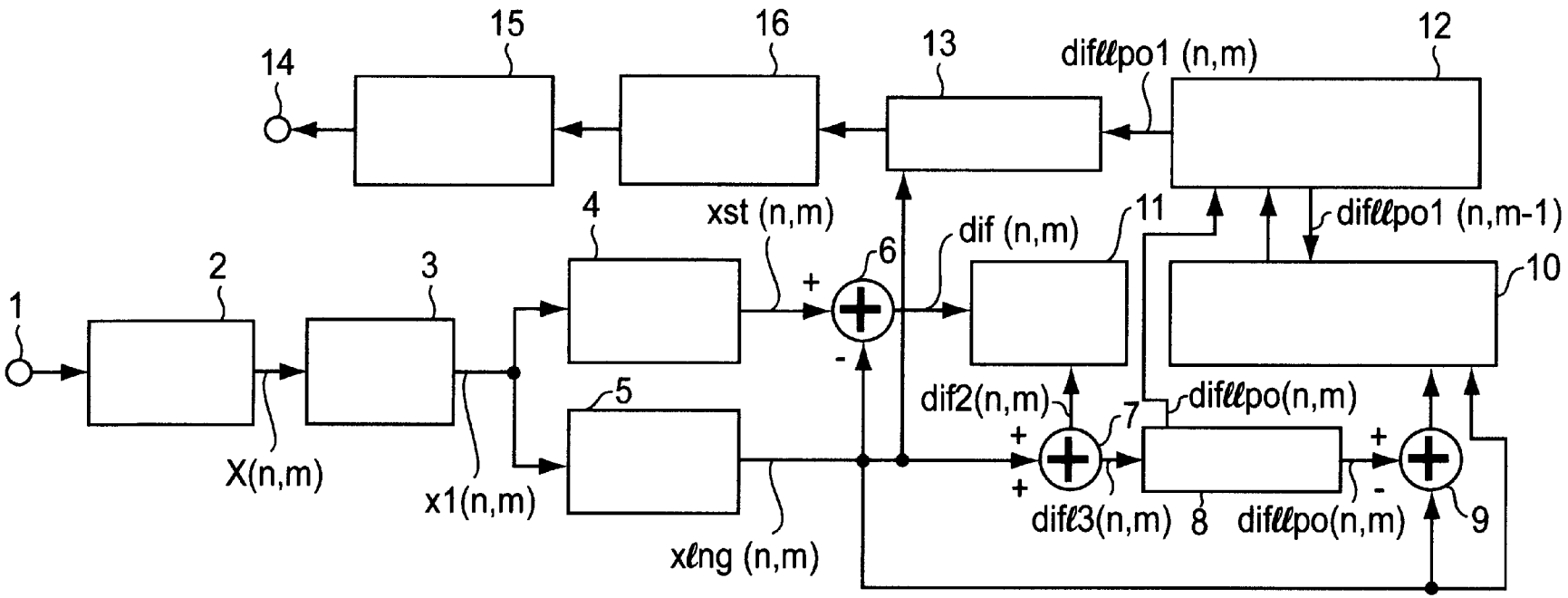
FIG. 5 is a schematic block diagram showing a voice detector of a third embodiment of the invention.

The following is a description of the second embodiment of a voice detector of the invention. The voice detector of the second embodiment illustrates a case in which a frame length is longer than that in the first embodiment. In other words, it concerns a case in which the shortest actual voice term extends over at least two frames, e.g., 10 ms; 80 samples. FIG. 5 is a block diagram showing the voice detector of the second embodiment. The same elements corresponding to elements in the first embodiment are referenced with the same numerals. In FIG. 4, a voice detector of the second embodiment comprises a voice signal input terminal 1, a frame divider 2, two absolute value calculators 3 and 11, a short-term averaging circuit 4, a long-term averaging circuit 5, three adders 6, 7 and 9, a smoothing filter 8, a noise level discriminator 10, a noise level identifier 12, a voice discriminator 13, an output terminal 14 and also a contiguous frame control unit 15. These elements, excepting for the front and the rear frame voice control unit 15, have the same functions as those of the first embodiment.

The contiguous frame control unit 15 changes to voiced frames, as necessary, the designation of a predetermined number s of frames immediately to the front and rear of a frame discriminated at the voice discriminator 13 to be a voiced frame. The control unit then outputs a signal designating the same, to the output terminal 14. The number s of frames compulsorily changed is optional. For example, if the frame length is 10 ms, s can be set to 1. In other words, s is determined according to the frame length.

This detector of the second embodiment has various unprecedented advantages in addition to those of the first embodiment which are described above. Thus, the contiguous frame control unit 15 is provided after the voice discriminator 13, and compulsorily designates as a voiced frame or changes, as necessary, the designation to a voiced frame, each of s frames to the front and rear of a frame discriminated as a voiced frame by the voice discriminator 13. Therefore, even if the frame length is short, the control unit 15 prevents an incorrect discrimination of the voiced frame as an unvoiced frame.

Such a control unit is advantageously provide whether the frame length is short or long in order to prevent voiced frames from being wrongly designated as unvoiced. However, particularly if the frame length is short, providing the contiguous frame control unit 15 after the voice discriminator 13 in order to compulsorily designate "s" frames before and after the voiced frame to be voiced frames, because the number of samples is smaller in a short frame than in a long frame. That is, the chance of an erroneous designation of a frame as unvoiced is greater with a short frame than with a long frame, without the provision of the contiguous frame control unit 15.

<Third Embodiment>

The following is a description of the third embodiment of a voice detector of the present invention. The voice detector of the third embodiment illustrates a case in which a frame length is shorter than that in the first embodiment. FIG. 5 is a block diagram showing the voice detector of the third embodiment. The same elements corresponding to the elements in FIG. 4 of the second embodiment are referenced with the same numerals in the third embodiment. As shown in FIG. 4 and FIG. 5, the difference between the second embodiment and the third embodiment is that the third embodiment has a voice frame discriminator 16 in addition to the elements of the second embodiment. The elements excepting the voice frame discriminator 16, have the same functions as the elements of the second embodiment.

The voice frame discriminator 16 is provided between the voice discriminator 13 and the contiguous frame control unit 15. The voice frame discriminator 16 watches the voice discrimination results output by the voice discriminator 13, of a continuous "t" (t=about 3 or 4) frames. If the result is that both the first and last of t continuous frames are voiced, and any of the "t−2" intermediate frames are designated unvoiced, the voice frame discriminator 16 compulsorily the unvoiced frame or frames designated unvoiced to voiced, and then outputs the resulting voice designation signal to the contiguous frame control unit 15. Since the intermediate frame or frames usually constitute a transition period between voiced frames, and the intermediate frame(s) should be discriminated as voiced frame(s), the voice frame discriminator 16 changes as necessary the intermediate frame or frames to voiced frame or frames. For example, if the "$n-1^{th}$" frame is a voiced frame, the "$n^{th}$" frame is designated to be an unvoiced frame and the "$n+1^{th}$" frame is a voiced frame, the voice frame discriminator 16 changes the designation of the "$n^{th}$" frame from unvoiced to voiced. However, upon the discrimination of the continuous frames from the "$n^{th}$" frame to the "$n+2^{th}$" frame, the discriminator 16 recognizes that the "$n^{th}$" frame was originally designated to be an unvoiced frame when it is discriminating whether or not, the "$n+1^{th}$" frame should be changed from an unvoiced frame to a voiced frame.

This detector of the third embodiment has various unprecedented advantages in addition to those described for the second embodiment.

The detector has the voice frame discriminator 16 between the voice discriminator 13 and the contiguous frame control unit 15, which compulsorily changes the intermediate unvoiced frame or frames between voiced frames, to voiced frame or frames. Even if the voice discriminator wrongly discriminates the frames related to a nonvowel sound as unvoiced frames, the voice detector can discriminate it as a voiced frame.

While the present invention has been described with reference to the particular illustrative embodiments, it is not to be restricted by those embodiment. It is to be appreciated that those skilled in the art can change or modify the embodiments without departing from the scope thereof. For example, the frame divider of the described embodiments divides the frames without overlapping the samples in each frames. However, the divider may divide the frames with overlapping, the part of the samples at the start and the end of each frame. Instead of the frame divider, the detector may divide the frames when the voice discriminator discriminates.

If the data from the absolute value calculator 3 is data taken within 0 to 256, the data may be omitted. A square value calculator may be adapted instead of the absolute value calculator 3. Also, a square value calculator may be adopted instead of the absolute value calculator 11.

In the above mentioned embodiments, when the noise level does not change, the detector holds the immediately previous noise level value. However, in this case, the smoothing calculation between the output difllpo(n,m) of the smoothing filter and the noise level difllpol(n,m) just before that may be adopted. The smoothing coefficient needs to be different from that on the change of the noise level. The detector may be adapted to take another look at the background noise level over 2 or 3 samples, not in a sample. In the third embodiment, the positions of the voice frame discriminator 16 and the contiguous frame control unit 15 can be reversed.

This application claims the foreign priority benefits of Japanese patent application serial number 09-112250, filed Apr. 30, 1997, the entire disclose of which is incorporated herein by reference.

What is claimed is:

1. A voice detector identifying a current input voice signal comprising:

a long-term averaging circuit for calculating a long-term weighted average value of the current input voice signal;

a short-term averaging circuit for calculating a short-term weighted average value of the current input voice signal;

a level identification circuit for identifying a noise level based on the long-term weighted average value and the short-term weighted average value and outputting a discrimination level indicative of the identified noise level; and a voice discriminator for comparing the long-term weighted average value with the discrimination level and determining whether the current input voice signal is a voiced term or an unvoiced term based on a result of the comparison.

2. A voice detector according to claim 1, wherein the level identification circuit includes:

an off-set adding circuit for determining a changeable off-set based on the long-term weighted average value and the short-term weighted average value and adding the changeable offset to the long-term weighted average value to obtain an off-set added long-term weighted average value;

a noise level discriminator for discriminating whether or not the noise level is renewed, based on the off-set added long-term weighted average value, the long-term weighted value and a just prior level identified based on short and long-term weighted average values calculated by the long and short-term averaging circuits for an input voice signal input to the voice detector just prior to the current input voice signal; and a noise level identifier for renewing the noise level when the noise level discriminator discriminates that the noise level is renewed and for holding the noise level when the noise level discriminator discriminates that the noise level is not renewed.

3. A voice detector according to claim 2, wherein the noise level identifier renews the noise level by calculating the just prior noise level and the off-set added long-term weighted average value, when the noise level is renewed.

4. A voice detector according to claim 2, wherein the noise level identifier holds the just prior noise level when the noise level is not renewed.

5. A voice detector according to claim 2, wherein the off-set adding circuit further comprises:

an absolute value calculator for calculating an absolute value of the difference between the long-term weighted average value and the short-term weighted average value, an adder for adding the absolute value and the long-term weighted average value, and a smoothing filter for processing the added value from the adder.

6. A voice detector according to claim 2, wherein the noise level discriminator subtracts the long-term weighted average value from the changeable off-set added long-term weighted average value to obtain the first discrimination value, subtracts the long-term weighted average value from the noise level to obtain the second discrimination value.

7. A voice detector according to claim 6, wherein the noise level discriminator discriminates to renew the noise level when the second discrimination value is larger that the first discrimination value.

8. A voice detector according to claim 1, wherein the current voice signal is a frame having a predetermined period and the voice discriminator determines that the current voice signal is voiced if the long-term weighted average value exceeds the discrimination value in at least one sample term in the frame.

9. A voice detector according to claim 2, further comprising a contiguous frame control circuit connected to the voice discriminator, said contiguous control circuit changing unvoiced terms positioned at the front and the rear of a voiced term, to voiced terms.

10. A voice detector according to claim 2, further comprising a voice frame discriminator connected to the voice frame discriminator, said voice frame detector changing an unvoiced term or terms between two voiced terms to a voiced term or terms, when the unvoiced term or terms are a predetermined number of terms.

* * * * *